US010584939B2

(12) United States Patent
Lamotte et al.

(10) Patent No.: US 10,584,939 B2
(45) Date of Patent: Mar. 10, 2020

(54) TORPEDO LAUNCHING TUBE AND NAVAL PLATFORM COMPRISING AT LEAST ONE SUCH TUBE

(71) Applicant: NAVAL GROUP, Paris (FR)

(72) Inventors: Arnaud Lamotte, Ruelle sur Touvre (FR); Philippe Roy, Ruelle sur Touvre (FR); Cyril Pelissier, Ruelle sur Touvre (FR)

(73) Assignee: NAVAL GROUP, Paris (FR)

( * ) Notice: Subject to any disclaimer, the term of this patent is extended or adjusted under 35 U.S.C. 154(b) by 0 days.

(21) Appl. No.: 16/079,198

(22) PCT Filed: Feb. 24, 2017

(86) PCT No.: PCT/EP2017/054391
§ 371 (c)(1),
(2) Date: Aug. 23, 2018

(87) PCT Pub. No.: WO2017/144696
PCT Pub. Date: Aug. 31, 2017

(65) Prior Publication Data

US 2019/0049216 A1 Feb. 14, 2019

(30) Foreign Application Priority Data

Feb. 25, 2016 (FR) ..... 16 00318

(51) Int. Cl.
*F41F 3/077* (2006.01)
*F41F 3/07* (2006.01)
*F41F 3/10* (2006.01)

(52) U.S. Cl.
CPC ..... *F41F 3/077* (2013.01); *F41F 3/07* (2013.01); *F41F 3/10* (2013.01)

(58) Field of Classification Search
CPC ..... F41F 3/077; F41F 3/07; F41F 3/10
USPC ..... 89/1.809
See application file for complete search history.

(56) References Cited

U.S. PATENT DOCUMENTS 1,327,614 A 1/1920 Grieshaber
3,106,905 A 10/1963 Gondek
(Continued)

FOREIGN PATENT DOCUMENTS

GB 254 257 A 11/1926

OTHER PUBLICATIONS

International Search Report, dated May 8, 2017, 2013, from corresponding PCT/EP2017/054391 application.

*Primary Examiner* — Samir Abdosh
(74) *Attorney, Agent, or Firm* — Young & Thompson

(57) ABSTRACT

Disclosed is an ordnance-launching tube, including a rear door and an expulsion circuit between a source of pressurized fluid and the tube, and provided with a unit for closing this circuit having an actuator that can be maneuvered by an operator in order to permit the expulsion, the actuator being associated with a detector for the presence of the rear door in the tube-closing position and with a lock for this rear door in the tube-closing position, which can be actuated via a bolt that the operator can move between a first position preventing expulsion and a second position permitting expulsion when the door is in the closing position and locked. The bolt includes an abutment movable between a position blocking the actuator in position to prevent expulsion, and a position releasing the actuator so that they may be actuated by the operator, and thus permit expulsion.

12 Claims, 5 Drawing Sheets

(56) References Cited

U.S. PATENT DOCUMENTS

Figure 1:
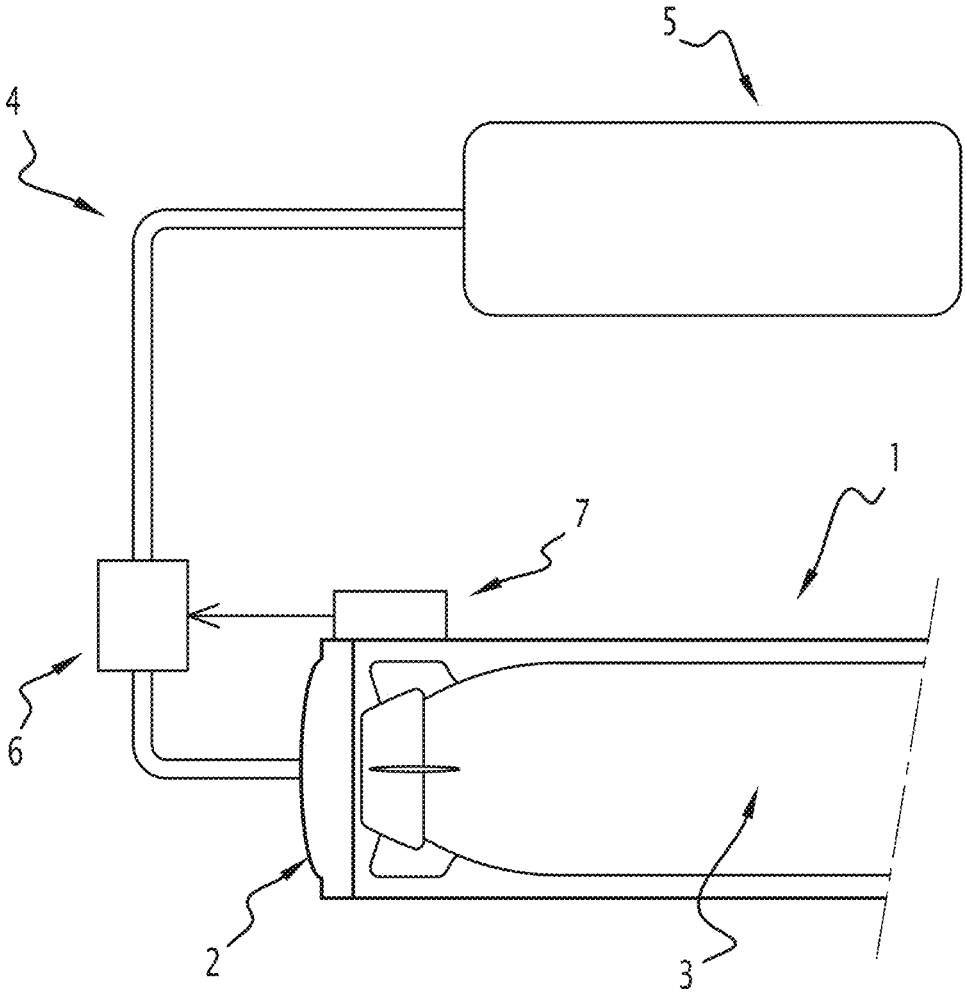

| | | | | | |
|---|---|---|---|---|---|
| 3,807,274 | A | * | 4/1974 | Cohen | F41F 3/10<br>89/1.81 |
| 3,818,637 | A | * | 6/1974 | Vivier | F41F 3/077<br>49/379 |
| 4,134,327 | A | * | 1/1979 | Piesik | F41F 3/077<br>89/1.8 |
| 5,388,545 | A | * | 2/1995 | Escarrat | B63G 5/00<br>114/238 |
| 5,886,285 | A | * | 3/1999 | Will | F42C 15/40<br>102/206 |

* cited by examiner

TORPEDO LAUNCHING TUBE AND NAVAL PLATFORM COMPRISING AT LEAST ONE SUCH TUBE

The present invention relates to an ordnance-launching tube, and in particular a torpedo-launching tube.

It also relates to a naval platform comprising at least one such tube.

More particularly, the invention relates to such a tube that includes a rear door and an expulsion circuit between a source of pressurized fluid and the tube.

Traditionally, such an expulsion circuit is provided with means for closing this circuit that comprise actuating means that can be maneuvered by an operator in order to permit/arm expulsion.

These actuating means are associated with means for detecting the presence of the rear door of the tube in the tube-closing position, and with means for locking this door in the tube-closing position.

These locking means can be actuated via a bolt, which the operator can move between a first position preventing expulsion and a second position permitting/arming expulsion, when the door is in the closing position and locked.

These different safety means have been developed and honed to guarantee the safety not only of operators, but also the equipment, in order to prevent any risk of firing or launching ordnance, while the rear door of the tube is not in the tube-closing position, or even not locked, with potentially serious consequences.

The safety systems that are currently known, and which are for example placed at the corresponding rear end of a torpedo-launching tube, then include a base fastened on the tube.

This base is provided with means for detecting the door in the closed position and which include a detection finger movable by the door, when the latter is in the tube-closing position.

This then allows the operator to push a sliding bolt, to move the latter between a first position and a second position in which the bolt has pushed a door bolt toward a position locking the rear door of the tube, in the tube-closing position.

In the known systems, this movement of the bolt also makes it possible to release a blocking trigger in position of the actuating means making it possible to close the expulsion circuit.

Once the bolt is in the unblocking position, an operator can then move the trigger from a blocking position to a retracted position, which allows the operator to maneuver the closing or arming lever of the expulsion circuit.

It will be noted that different embodiments of the expulsion circuit and closing or arming means thereof can be considered.

Indeed, these closing means can be means forming an expulsion valve directly, or means for arming such an expulsion valve, or means for maneuvering isolating means of the expulsion circuit, in order to close the latter and therefore permit the expulsion.

One can see, however, that all of these structures have a certain number of drawbacks, since they include a relatively large number of parts and also require a significant number of maneuvers.

The invention therefore aims to resolve these problems.

To that end, the invention relates to an ordnance-launching tube, of the type comprising a rear door and an expulsion circuit between a source of pressurized fluid and the tube, and provided with means for closing this circuit that comprise actuating means that can be maneuvered by an operator in order to permit the expulsion, these actuating means being associated with means for detecting the presence of the rear door in the tube-closing position and with means for locking this rear door in the tube-closing position, which can be actuated via a bolt that the operator can move between a first position preventing expulsion and a second position permitting expulsion when the door is in the closing position and locked, characterized in that the bolt comprises abutment means that can be moved between a position blocking the actuating means in position in order to prevent expulsion, and a position releasing these actuating means so that they may be actuated by the operator, and thus permit expulsion.

According to other features of the tube according to the invention, considered alone or in combination:

- the means for detecting the door in the closed position include a detection finger movable by the door when the latter is in the tube-closing position;
- the means for locking the door in the closing position comprise a bolt movable toward a position for locking by the bolt under the action by the operator, when the door is in the closing position;
- the actuating means comprise a lever able to be actuated by an operator;
- the abutment means of the bolt are suitable for cooperating with cam-forming means connected to the actuating means to prevent or permit them moving depending on the position of the bolt-forming means;
- the cam-forming means are provided with an aperture comprising, at one end, a wider portion for receiving a complementary wider portion of the bolt to block the cam and therefore the actuating means in position so as to prevent expulsion when the bolt is in its first position, the bolt comprising a portion with a reduced section complementary to that of the rest of the aperture of the cam, permitting, when the bolt is in its second position and therefore its complementary portion of reduced section across from the aperture, the movement of the cam and therefore the actuating means, so as to permit expulsion;
- the bolt is movable transversely to the cam between its positions and assumes the form of a rod having two portions with different sections forming the portions intended to cooperate with the cam to block or release the latter;
- the actuating means and the cam are mounted rotating on the valve-forming means and the aperture of this cam has a curved shape;
- the closing means of the expulsion circuit comprise an expulsion valve and in that the actuating means are suitable for maneuvering this expulsion valve directly in order to trigger expulsion;
- the closing means of the expulsion circuit comprise means for arming an expulsion valve and in that the actuating means are suitable for maneuvering these arming means in order to permit expulsion;
- the closing means of the expulsion circuit comprise an expulsion valve and isolating means of the expulsion circuit and in that the actuating means are suitable for maneuvering these isolating means in order to permit expulsion.

According to another aspect, the invention also relates to a naval platform, which includes at least one ordnance-launching tube as described above.

This platform is for example formed by a surface vessel.

Figure 2:
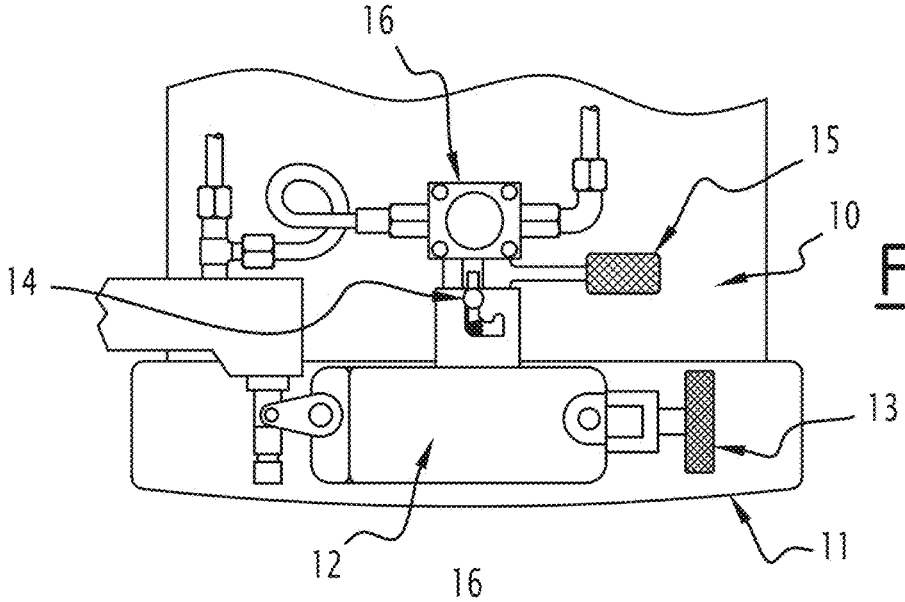
Figure 3:
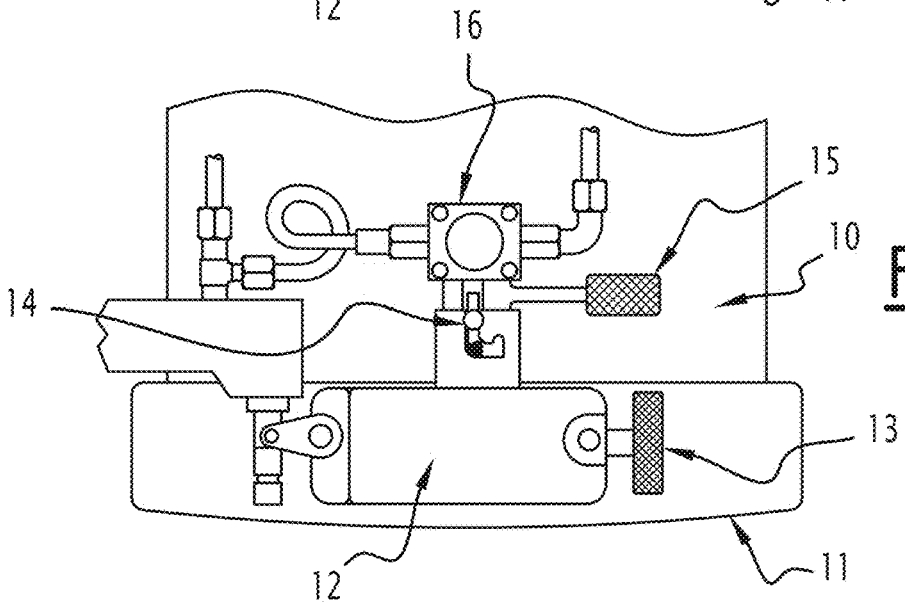
Figure 4:
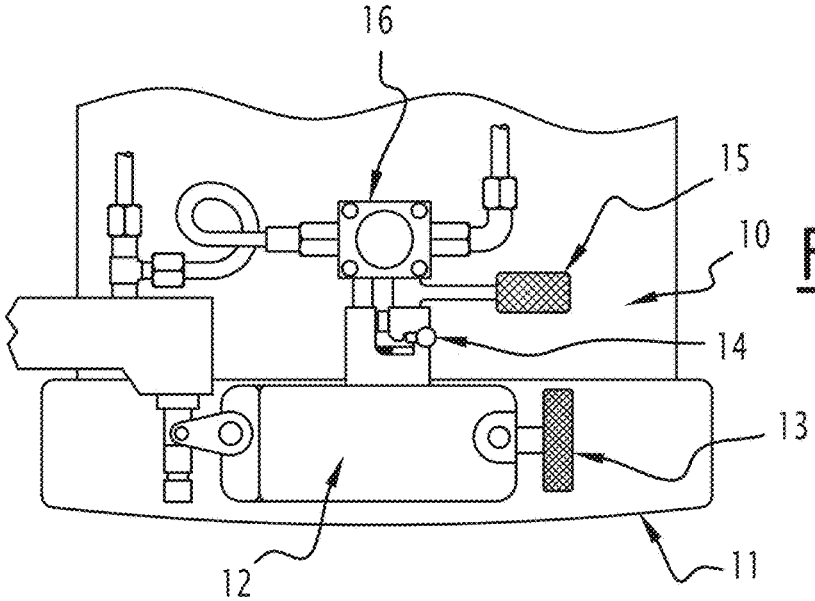
Figure 5:
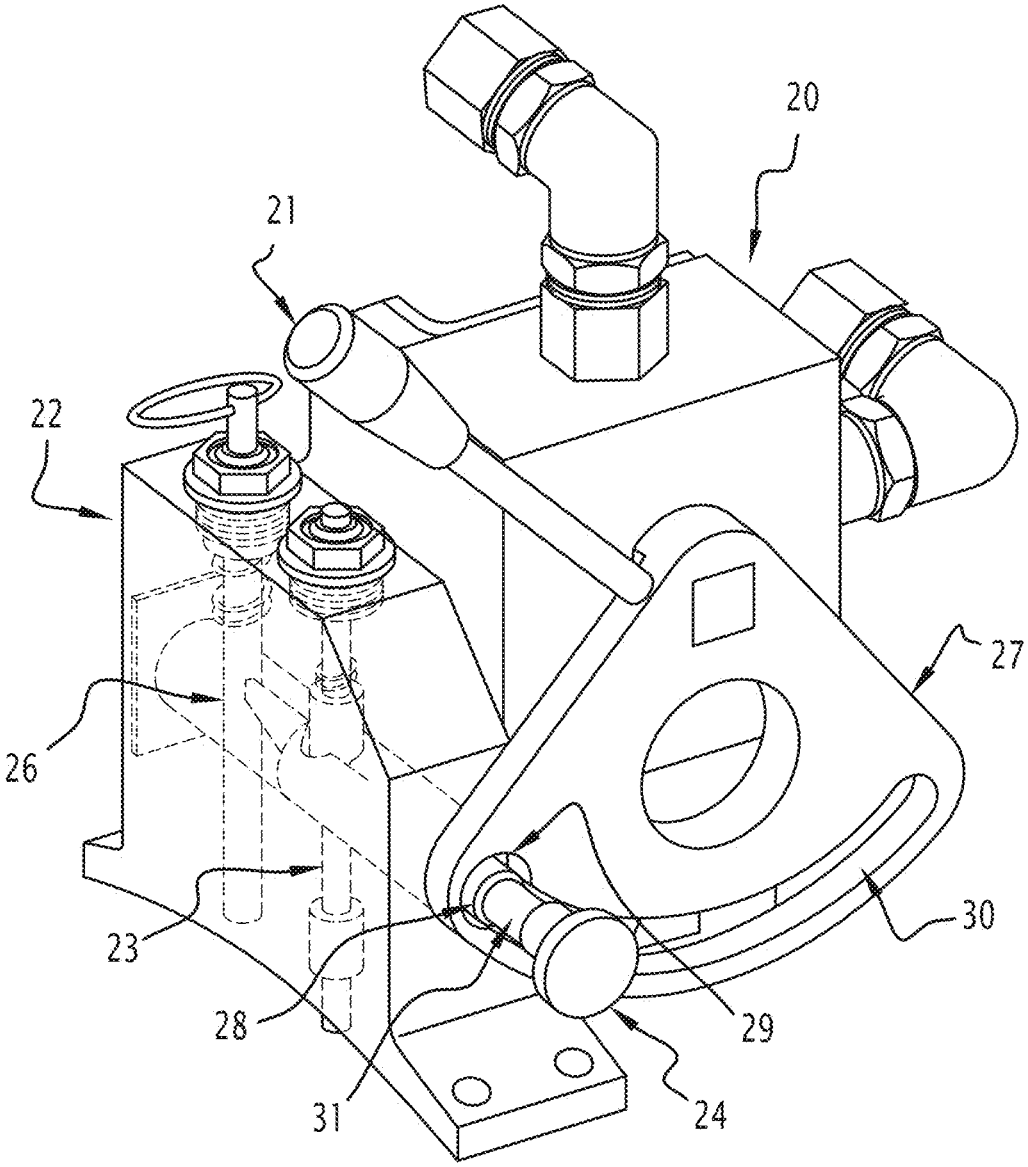
Figure 8:
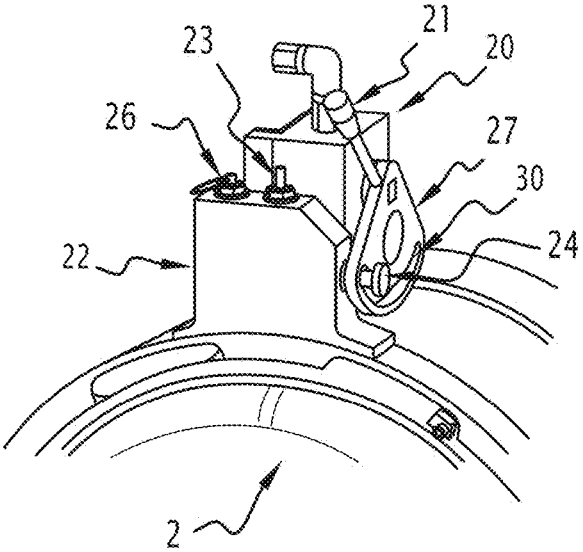
Figure 9:
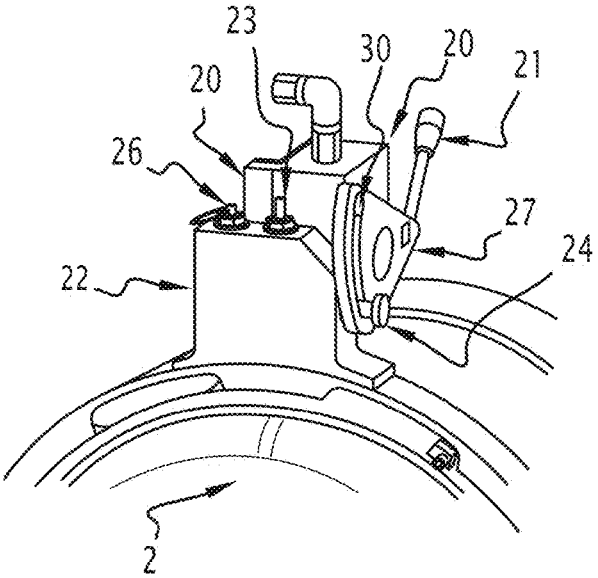
Figure 10:
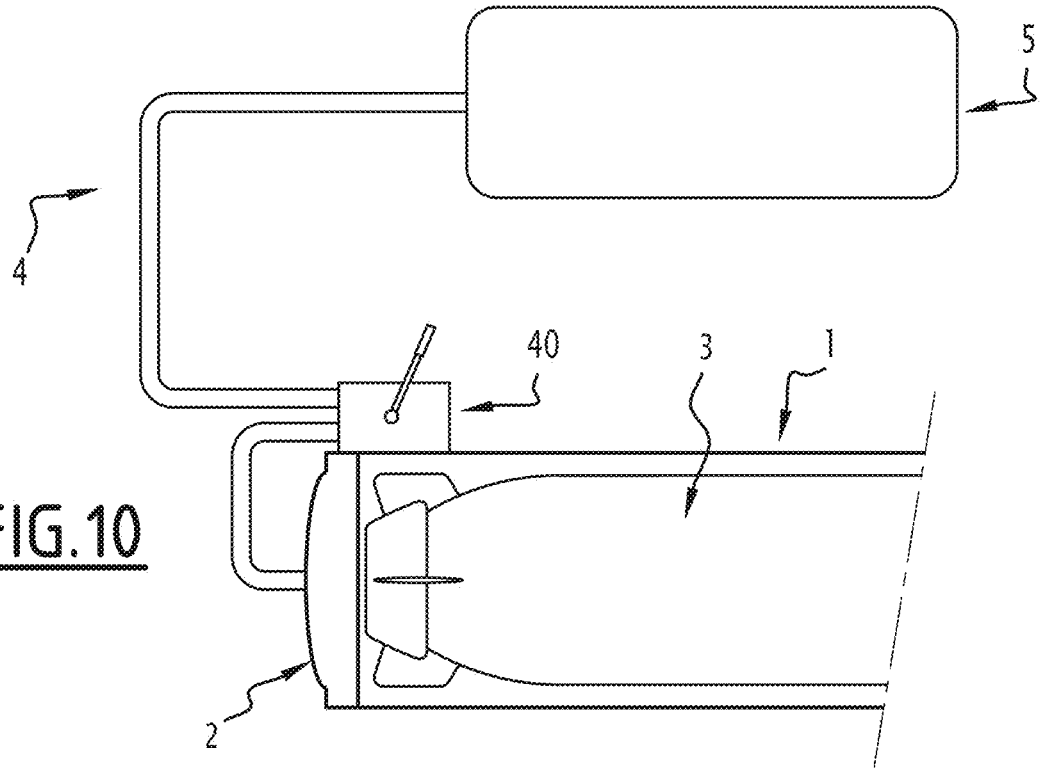
Figure 11:
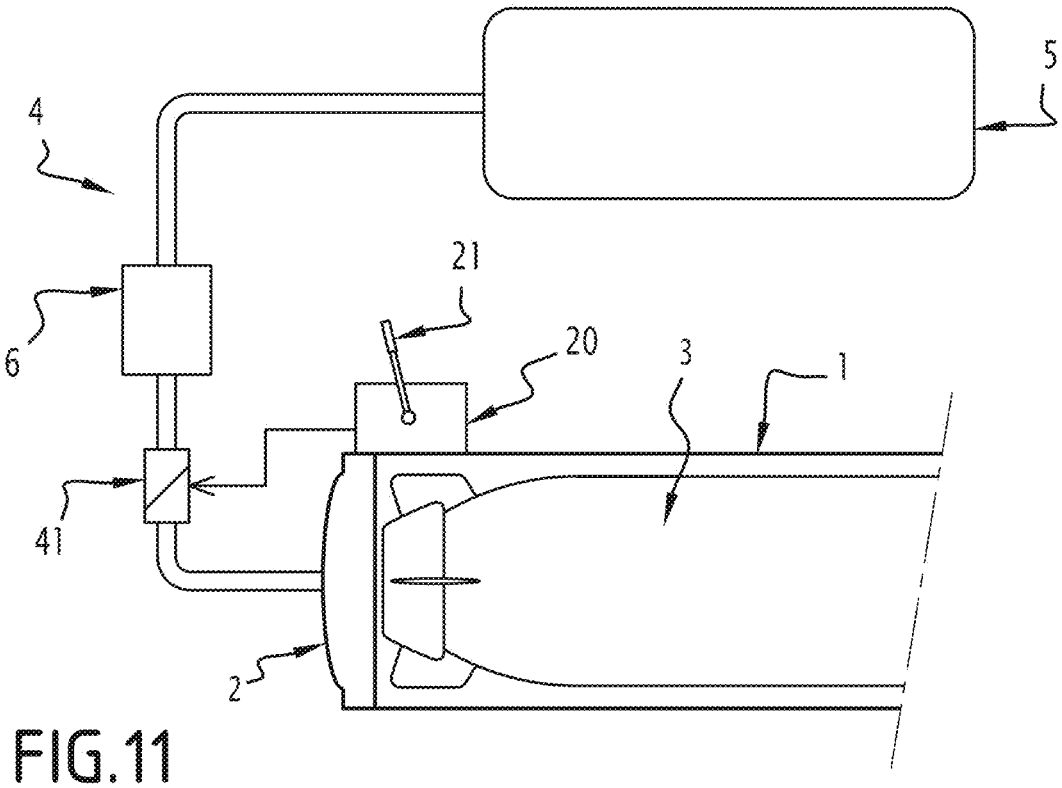

The invention will be better understood using the following description, provided solely as an example and done in reference to the appended drawings, in which:

FIG. 1 shows a block diagram illustrating the general structure of an ordnance-launcher such as a torpedo-launcher, according to the invention, FIGS. 2, 3 and 4 show different positions of closing or arming means of an expulsion circuit of the state of the art, FIG. 5 shows a perspective view of closing or arming means of such an expulsion circuit, according to the invention, FIGS. 6, 7, 8 and 9 illustrate the operation of these closing or arming means for such an expulsion circuit according to the invention, and FIGS. 10 and 11 show alternative embodiments of such closing or arming means.

FIG. 1 in fact illustrates an example embodiment of an ordnance-launching tube, such as a torpedo-launching tube, according to the invention.

In general, this tube is designated by general reference 1 and includes a rear door designated by general reference 2.

This door is then removable to make it possible to open the rear end of the tube in order to load the ordnance, and in particular the torpedoes, through this rear end of this tube.

In the launching position of the tube, this rear door 2 must be in the tube-closing position and locked.

Ordnance such as a torpedo is designated by general reference 3 in this FIG. 1.

This tube 1 is also associated with an expulsion circuit, which is designated by general reference 4, extending between a source of pressurized fluid, designated by general reference 5, for example made up of a compressed air reservoir, and the rest of the tube 1.

In the described example, this expulsion tube 4 for example comprises an expulsion valve, designated by general reference 6, making it possible to trigger the expulsion and therefore firing of the ordnance.

The operation of this expulsion valve 6 is, in the described example, made subject to an expulsion authorization/arming signal, delivered by means 7 for detecting the rear door 2 of the tube, in the closing position and locked in this position.

Indeed and as previously indicated, the expulsion can only be triggered if the rear door of the tube is closed and locked in the closing position.

FIGS. 2, 3 and 4 illustrate the operation of an example embodiment of means for permitting/arming such an expulsion according to the state of the art.

These figures in fact show an ordnance-launching tube 10, a rear tube door 11, a mechanism for detecting the position of this rear door in the closing position and locking thereof in this closing position, designated by general reference 12, a maneuvering bolt 13, a trigger 14 and a lever 15 for actuating a valve 16 for permitting/arming the expulsion.

The operation of this system, derived from the state of the art, is as follows.

When the rear door 11 of the tube 10 is in the closed position, the latter pushes a detection finger that releases the bolt 13 and allows the operator to push this bolt 13, as illustrated in FIGS. 2 and 3.

By pushing this bolt 13, the operator moves a locking finger of the rear door of the tube toward its locking position, which releases the trigger 14.

The operator can then move this trigger 14 from the position illustrated in FIG. 3 toward the position illustrated in FIG. 4, which releases the lever 15.

The operator can then maneuver this lever 15 and therefore the valve 16 to permit/arm the expulsion.

One can then see that the system makes it possible to guarantee the safety of the tube and the operators thereof, the expulsion only being permitted when the rear door of this tube is indeed in the closing position and locked.

However, as previously indicated, such a system has a certain number of drawbacks in terms of the number of parts used, and the complexity of the implementation of this system.

To resolve these problems, the Applicant proposes to simplify the structure of these means.

FIG. 5 in fact shows a perspective view of one example embodiment of a safety system according to the invention.

The latter still for example includes a valve, designated by general reference 20.

Such a valve 20 for example includes a compressed air inlet and outlet for example making it possible to trigger or arm the expulsion.

The valve 20 for example directly makes up the expulsion valve, or it for example makes it possible to arm an expulsion valve of the expulsion circuit, or it may for example make it possible to maneuver, for instance, an isolating system of the expulsion circuit as will be described in more detail hereinafter.

In any case, this valve 20 is associated with an actuating lever by an operator, designated by general reference 21, which therefore makes it possible to maneuver this valve 20.

As previously described, this system also includes a fastening base 22 on the tube.

This base 22 includes, similarly to what was previously described, a detection finger 23 of the rear door 2 of the tube in the closing position of the rear end of this tube.

This finger 23 is then mounted slidingly movable by the rear door of the tube, in a corresponding hole of this base 22, to release a bolt, designated by general reference 24 in this FIG. 5, and to allow an operator to move this bolt slidingly in the base, by pushing it into the latter.

By moving this bolt 24, i.e., for example by pushing it into the base, from the position illustrated in this FIG. 5, the operator then causes a bolt 26 to be lowered into the active locking position of the rear door of the tube in the closed position.

Advantageously, the detection finger 23 and the bolt 26 include resilient means for stressing in the low and high positions, respectively.

This operation is similar to what was described previously regarding the systems of the state of the art.

Indeed, a bolt is then associated with means for detecting the position of the door in the closing position to permit the operator, by acting on this bolt, to move a blocking bolt of the door into the closed and locked position.

According to the invention, the bolt 24 is provided with abutment means movable between a position blocking the actuating means in position, to prevent expulsion, and a position releasing these actuating means, to permit their actuation by the operator and therefore to permit/arm expulsion.

Indeed, this bolt 24 is suitable for cooperating with cam-forming means, connected to the actuating lever 21, and designated by general reference 27, to permit or prevent their movement depending on the position of the bolt-forming means 24.

As illustrated, the bolt 24 in fact comprises a wider portion, designated by general reference 28, suitable for extending in a wider portion 29 of an aperture 30 of the cam 27 so as, in a first position of this bolt, to block this cam 27 and therefore the lever 21 in position, in order to prevent expulsion when the bolt 24 is in this first position.

When the operator has moved the bolt 24 toward its second position, for example by causing the latter to slide and pushing it into the base 22, a portion of reduced section 31 of this bolt 24 comes across from the aperture 30 of the cam 27, which allows the operator to maneuver the lever 21 and therefore the valve 20.

As a reminder, the operator can only move the bolt 24 from its first blocking position toward its second permission permitting/arming the expulsion when the rear door 2 of the tube is in its closing position and locked.

In the example embodiment illustrated in this FIG. 5, the lever 21 and the cam 27 are mounted rotating or pivoting on the rest of the valve 20 and the bolt 24 is mounted movable transversely to the cam 27 between these two positions by sliding in the base 22.

The body of this bolt 24 then assumes the form of a rod having two portions with different sections forming the portions 28 and 31 thereof, intended to cooperate with the cam 27 in order respectively to block or release it.

In this example embodiment as well, given that the lever 21 and the cam 27 are mounted rotating or pivoting on the valve-forming means 20, the aperture 30 of this cam 27 has a curved shape.

Of course, other embodiments can be considered.

FIGS. 6 to 9 illustrate the closing/arming sequence of the expulsion circuit of such a tube.

Figure 6:
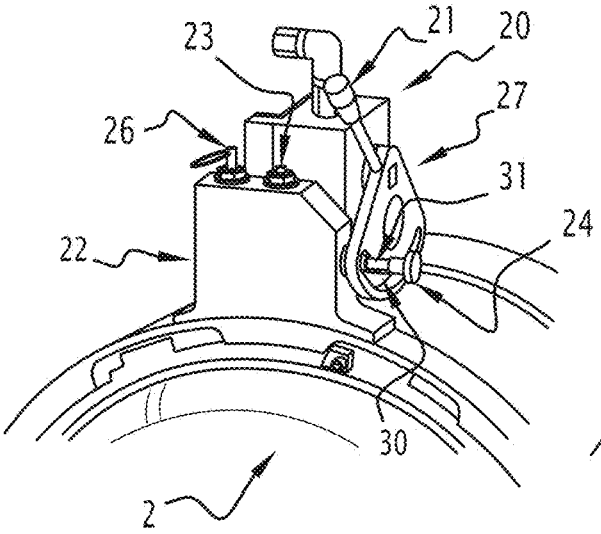

In FIG. 6, the rear door 2 of the tube is not in the closing position.

The detection finger 23 is therefore in the lower position and the bolt 24 is in the position blocking the cam 27 associated with the lever 21.

Figure 7:
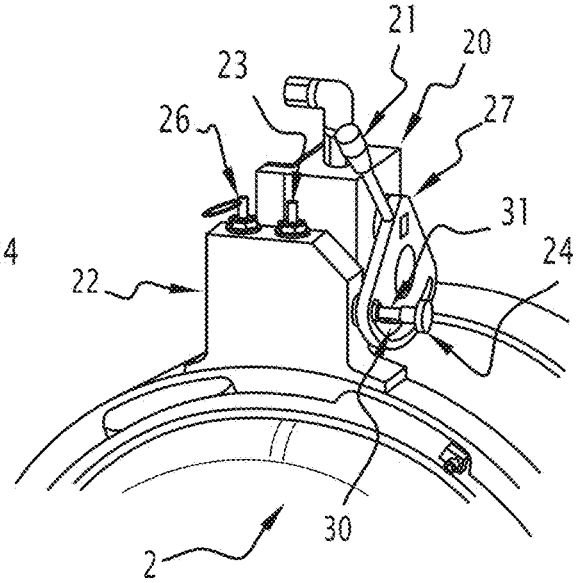

During the placement of the rear door 2 in the closing position, as illustrated in FIG. 7, the detection finger 23 rises, which permits the operator, as illustrated in FIG. 8, to push the bolt 24 by pushing it into the base and therefore to move the bolt 26 toward its position locking the rear door of the tube in the closing position.

At the same time, the portion of reduced section 31 of the bolt 24 comes across from the rest of the aperture 30 of the cam 27 associated with the lever 21, which allows the operator to maneuver this lever 21 and therefore to maneuver the valve 20, as illustrated in FIG. 9.

One can then see that this makes it possible to make the launch of the ordnance more reliable and secure it, the corresponding tube being able to be placed on board a naval platform such as a surface vessel or the like.

It has previously been indicated that different embodiments could be considered.

Thus, for example, the lever 21 and the valve 20 may form means making it possible to arm an expulsion valve directly, as shown by FIG. 1.

In this case, the pressurized air from the valve 20 is used to arm the expulsion valve 6, which can be controlled elsewhere.

However and as illustrated in FIG. 10, the valve and the corresponding lever can directly form the expulsion valve.

In this case, the expulsion valve is inserted directly in the expulsion circuit between the source of pressurized fluid and the tube, as illustrated in FIG. 10.

In FIG. 10, the fluid source is still designated by general reference 5, the tube by general reference 1, the expulsion circuit by general reference 4 and the expulsion valve by general reference 40.

In this case, this valve 40 is directly associated with the various means that have been described above, namely the detection finger for the closing position of the door, the bolt, the door lock, etc.

In the example embodiment illustrated in FIG. 11, the valve that has been described in light of the preceding figures is used to maneuver isolating means, integrated into the expulsion circuit.

In this FIG. 11, the source of pressurized fluid is still designated by general reference 5, the tube by general reference 1, the expulsion circuit by general reference 4, the expulsion valve by general reference 6, the valve associated with the means for detecting the presence of the rear door, the lock and the bolt, by general reference 20, the actuating lever by general reference 21 and an isolating valve of this expulsion circuit, by general reference 41.

This valve 41 makes it possible to isolate the expulsion circuit, as long as the door 2 is not in the closing position and locked and the lever 21 in the open position of the valve 20, which makes it possible to permit or not permit the expulsion by controlling the isolating valve 41.

Of course, other embodiments may also be considered.

The invention claimed is:

1. An ordnance launching tube comprising:

a rear door and an expulsion circuit between a source of pressurized fluid and the tube, and further comprising means for closing the circuit that comprise actuating means that can be maneuvered by an operator in order to permit the expulsion, the actuating means being associated with means for detecting the presence of the rear door in the tube-closing position and with a locking means for this rear door in the tube-closing position which can be actuated via a bolt that the operator can move between a first position preventing expulsion and a second position permitting expulsion when the door is in the closing position and locked, wherein the bolt comprises abutment means that can be moved between a position blocking the actuating means in position in order to prevent expulsion, and a position releasing the actuating means so that they may be actuated by the operator, and thus permit expulsion.

2. The ordnance launching tube according to claim 1, wherein the actuating means comprise a lever that can be actuated by an operator.

3. The ordnance launching tube according to claim 1, wherein the abutment means of the bolt cooperate with a cam-forming means connected to the actuating means to prevent or permit movement depending on the position of the bolt.

4. The ordnance launching tube according to claim 3, wherein the cam-forming means are provided with an aperture comprising, at one end, a wider portion for receiving a complementary wider portion of the bolt to block the cam and therefore the actuating means in position so as to prevent expulsion when the bolt is in its first position, the bolt comprising a portion with a reduced section complementary to that of the rest of the aperture of the cam, permitting, when the bolt is in its second position and therefore its complementary portion of reduced section across from the aperture, the movement of the cam and therefore the actuating means, so as to permit expulsion.

5. The ordnance launching tube according to claim 4, wherein the bolt is movable transversely to the cam between its positions and assumes the form of a rod having two portions with different sections forming the portions intended to cooperate with the cam to block or release the latter.

6. The ordnance launching tube according to claim 5, wherein the actuating means and the cam are mounted rotating on a valve-forming means and the aperture of this cam has a curved shape.

7. The ordnance launching tube according to claim 1, wherein a closing means of the expulsion circuit comprise an expulsion valve and wherein the actuating means are suitable for maneuvering this expulsion valve directly in order to trigger expulsion.

8. The ordnance launching tube according to claim 1, wherein a closing means of the expulsion circuit comprise means for arming an expulsion valve and wherein the actuating means are suitable for maneuvering these arming means in order to permit expulsion.

9. The ordnance launching tube according to claim 1, wherein a closing means of the expulsion circuit comprise an expulsion valve and isolating means of the expulsion circuit and wherein the actuating means are suitable for maneuvering these isolating means in order to permit expulsion.

10. A naval platform, comprising at least one ordnance launching tube according to claim 1.

11. The platform according to claim 10, wherein the platform is formed by a surface vessel.

12. The ordnance launching tube according to claim 2, wherein the abutment means of the bolt cooperate with a cam-forming means connected to the actuating means to prevent or permit movement depending on the position of the bolt.

* * * * *